United States Patent [19]

Pelton

[11] 4,100,849

[45] Jul. 18, 1978

[54] CONTROL SYSTEM FOR REFUSE COMPACTER

[75] Inventor: John Franklin Pelton, Yorktown Heights, N.Y.

[73] Assignee: Union Carbide Corporation, New York, N.Y.

[21] Appl. No.: 690,281

[22] Filed: May 26, 1976

[51] Int. Cl.[2] ..... B30B 15/26

[52] U.S. Cl. ..... 100/41; 100/43

[58] Field of Search ..... 100/35, 41, 43, 192, 100/48, 50, 191, DIG. 8

[56] References Cited

U.S. PATENT DOCUMENTS

| | | | |
|---|---|---|---|
| 2,722,884 | 11/1955 | Seltzer | 100/43 |
| 3,511,174 | 5/1970 | Raab | 100/43 |

FOREIGN PATENT DOCUMENTS

| | | | |
|---|---|---|---|
| 875,441 | 8/1961 | United Kingdom | 100/43 |

*Primary Examiner*—Billy J. Wilhite
*Attorney, Agent, or Firm*—Lawrence G. Kastriner; Warrick E. Lee, Jr.

[57] ABSTRACT

A method for automatically controlling the restrictors in a ram-tube type refuse compacter or pelletizer. Variable restrictors near the discharge end of the tube control the compaction pressure exerted on the refuse as it is forced through the tube. The restrictors are capable of being moved inward and outward on each ram stroke in response to changes in the ram pressure required to advance the compacted refuse through the tube. The method comprises:

(1) measuring the ram pressure during the last smallest practicable increment of forward ram travel, (2) adjusting the restrictors slightly inward if the pressure measured in step (1) is less than a predetermined pressure $P_1$, (3) measuring the ram pressure when the ram is at the lock-out point, normally about 6 inches from the forward end of its stroke, (4) overriding step (2) by making no inward restrictor adjustment if the pressure measured in step (3) is less than a predetermined pressure $P_3$, (5) measuring the ram pressure during at least the last smallest increment of forward ram travel, and (6) adjusting the restrictors slightly outward if the pressure measured in step (5) is greater than a predetermined pressure $P_2$.

7 Claims, 6 Drawing Figures

FIG. 5
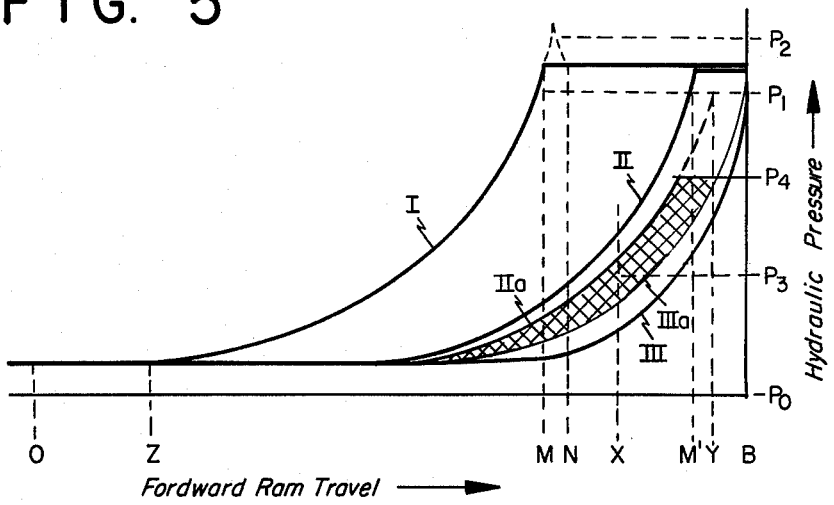
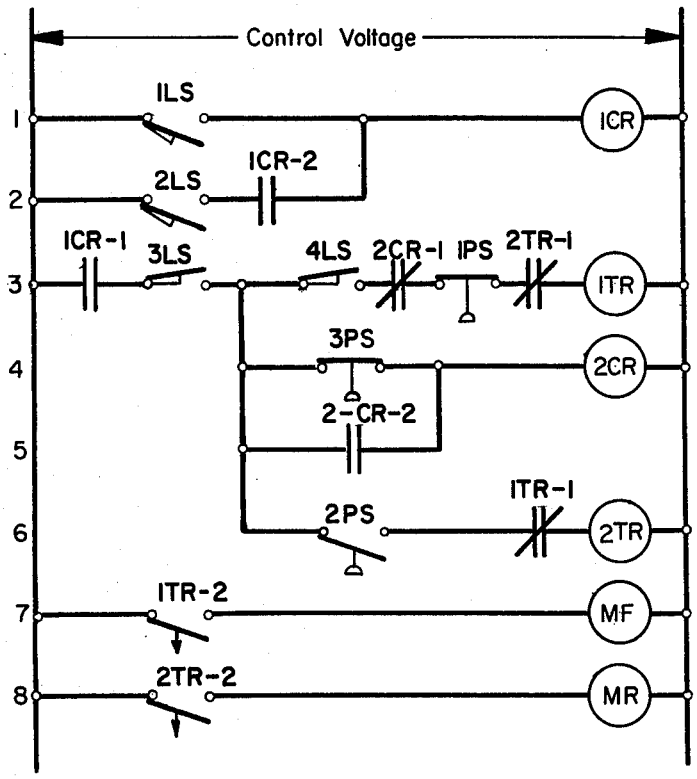
FIG. 6

CONTROL SYSTEM FOR REFUSE COMPACTER

BACKGROUND

This invention relates in general to a method or system for controlling the compaction pressure within a ramtube type of refuse compacter and more specifically to a system for automatically controlling the restrictors in apparatus which is capable of compacting refuse and forming coherent pellets therefrom, in response to changes in the pressure within said apparatus.

During the past several years considerable effort has gone into developing new technology for disposing of solid refuse in an environmentally acceptable manner and at the same time recovering, insofar as possible, the useful resources contained therein. One such process is described in U.S. Pat. No. 3,729,298 wherein solid refuse is fed into a vertical shaft furnace in which the combustible portion of the refuse is pyrolized - principally to a fuel gas consisting of carbon monoxide and hydrogen - and in which the uncombustible portion of the refuse is fluidized to molten metal and slag. An improvement on the process described in the above mentioned U.S. patent is described and claimed by J. E. Anderson in U.S. patent application Ser. No. 675,935, filed Apr. 12, 1976. The latter process requires that the refuse be compacted into strong, coherent pellets before being fed into the furnace.

In my U.S. application Ser. No. 675,934, filed Apr. 12, 1976, the entire disclosure of which is incorporated herein by reference, I have described and claimed a device for compacting refuse into pellets suitable for being fed into such furnace and for being used in said improved process. In summary, that device comprises:

(a) a cylindrical tube having an inlet end and a discharge end, a feed port in the side wall of the tube near the inlet end thereof, the open discharge end of said tube constituting the discharge port, and having a compacted refuse chamber whose length is shorter than the shortest critical length for the refuse to be pelletized, (b) a feed hopper for the refuse to be compacted having an outlet port communicating with the inlet port of said tube, (c) a reciprocating driven ram located in the inlet end of said tube and axially aligned therewith, the perimeter of said ram being in sliding contact with the inner surface of said tube, and capable of exerting a pressure of at least 200 psi on each forward stroke of the ram, and (d) means for restricting the flow of refuse through said tube, said that the degree of restriction is variable in response to changes in the force required to advance the column of compacted refuse through the tube.

The preferred structure of said restricting means comprises a plurality of axially elongated leaves, each of which constitutes a flush section of tube wall, flexibly attached at its upstream end to the tube, movable radially inward or outward of the tube axis at its downstream end, and having edge surfaces parallel to each other. A preferred embodiment of the invention comprises two parallel cylindrical tubes whose respective feed ports communicate with a single feed hopper, wherein the respective rams within each tube operate in tandem such that when one is retracted the other is extended.

OBJECTS

It is an object of the present invention to provide a method or system for automatically controlling the compaction pressure within a device for compacting refuse in response to changes in the pressure required to force the refuse through said device such that the compaction pressure remains within a preselected range.

It is another object of this invention to provide a method or system for maintaining the compaction pressure of the pelletizing compacter described in my copending U.S. application Ser. No. 675,934, filed Apr. 12, 1976 within a preselected range by automatically controlling the position of its mechanical restrictors in response to changes in ram pressure.

SUMMARY OF THE INVENTION

A process for automatically controlling the amount of restriction in apparatus for compacting refuse comprising: (a) a cylindrical tube having an inlet end and a discharge end, a feed port in the side wall of the tube near the inlet end, an axially-aligned, reciprocating, driven ram in the inlet end, and a discharge port in the open discharge end of said tube and (b) a plurality of restrictors near the discharge end of the tube for controlling the compaction pressure exerted on the refuse, said restrictors being capable of being moved inward and outward during each ram stroke in response to changes in the ram pressure required to advance the refuse through said tube, said process comprising the steps of:

(1) measuring the ram pressure during the last smallest practicable interval of forward ram travel (normally this is about 1 inch from the forward end of its stroke), (2) adjusting the restrictors inward a predetermined distance if the ram pressure measured in step (1) is less than a predetermined pressure $P_1$, (3) measuring the ram pressure when the ram is at the lock-out point in its forward stroke (normally this is about 6 inches from the forward end of its stroke), (4) overriding step (2) by making no inward restrictor adjustment if the pressure measured in step (3) is less than a predetermined pressure $P_3$, where $P_3$ is the lock-out pressure and is less than $P_1$, (5) measuring the ram pressures during at least the last smallest practicable interval of forward ram travel (it may be measured starting from the point when the ram enters the compaction zone), and (6) adjusting the restrictors outward a predetermined distance if the ram pressure measured at any time in step (5) is greater than a predetermined pressure $P_2$, where $P_2$ is greater than $P_1$.

THE DRAWINGS

FIG. 5 is a graph illustrating the relationship between ram pressure and ram travel for different refuse loadings.

FIG. 6 illustrates a preferred electrical circuit for automatically controlling the position of the mechanical restrictors in response to changes in the ram pressure in accordance with the present invention.

DETAILED DESCRIPTION

Figure 1:
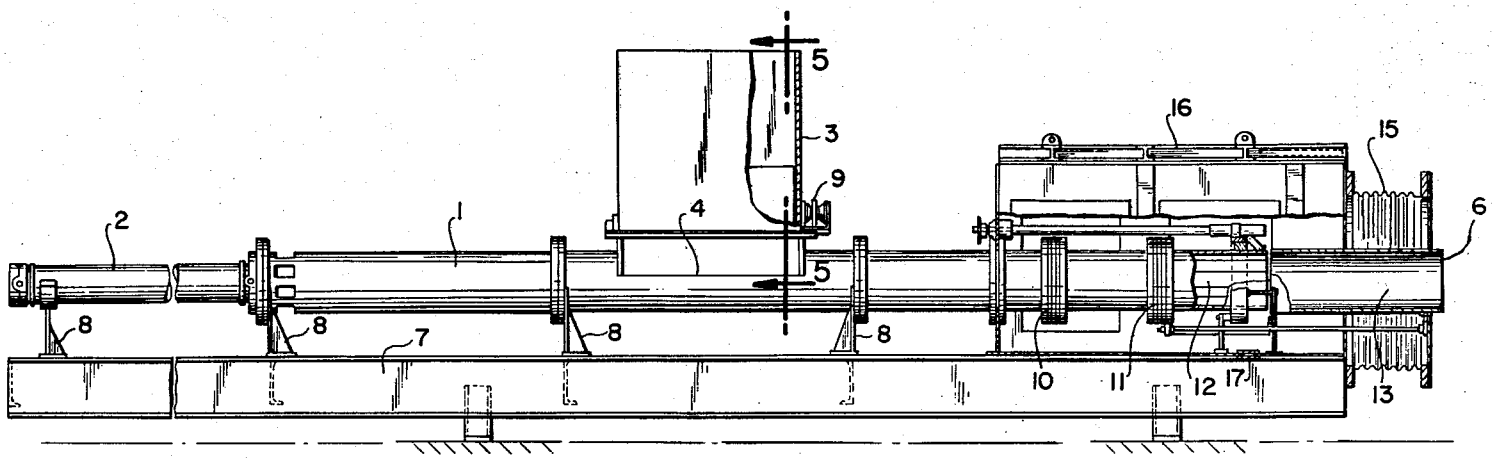
FIG. 1 is a side view in partial cross-section illustrating the preferred embodiment of the apparatus controlled by the method of the present invention.
Figure 2:
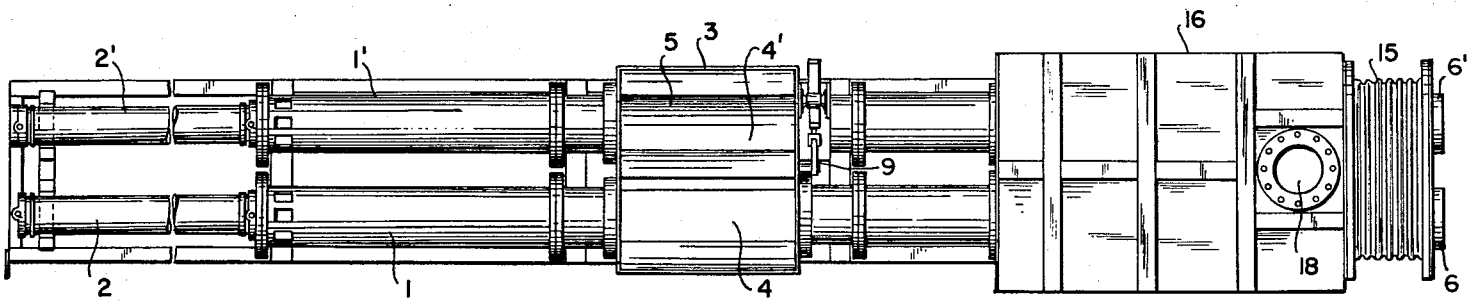
FIG. 2 is a top view of FIG. 1.

FIGS. 1 and 2 disclose in side and top views, respectively, a double barreled pelletizing refuse feeder which constitutes the invention claimed in my copending U.S. application Ser. No. 675,934 referred to above. The apparatus consists of two identical parallel cylindrical tubes 1 and 1' into which refuse is fed from a common hopper 3 through feed inlet ports 4 and 4' located in the tops of the respective tubes 1 and 1'. The refuse is directed into the tubes and contained therein with the aid of a rotating vane 5. Tubes 1 and 1' are most conveniently constructed from a plurality of flanged sections of steel tubing conventionally bolted together. The flanged back end of tubes 1 and 1' are bolted to hydraulic cylinders 2 and 2' which drive rams axially aligned within the feed ends of each tube. The perimeter of each ram is in sliding contact with the inner surface of each tube. Each ram is capable of exerting a pressure in excess of 1000 psi upon the refuse in the tube, thereby being capable of compressing the refuse to a density of at least 20 lbs/ft$^3$ and of pushing the compacted refuse through the tube and out the discharge ports 6 and 6'. The pelletizer apparatus rests upon a base frame 7 to which the pelletizer is firmly secured through a plurality of supports 8. The rotating vane 5 is driven by means of a conventional drive means 9. Means for dewatering the refuse 10 and 11 are located near the downstream end of the tubes. The variable restrictor assembly 12, which constitutes an end section of each of the tubes 1 and 1', is disclosed in greater detail in FIG. 4. The discharge end of the restrictor assembly 12 communicates with the discharge conduit 13, the diameter of which is greater than that of tube 1.

In order to provide a vapor tight seal between the pelletizer and a furnace, a flexible sleeve 15 surrounds tubes 1 and 1', connecting the feed port of a furnace and the housing 16 which surrounds the forward end of the pelletizer. Restrictor assembly 12 as well as the dewatering means 10 and 11 are located inside of the vapor tight housing 16 in order to prevent gases from escaping to the atmosphere. Housing 16 is provided with a drainage plug 17 through which any accumulation of liquid may be either periodically discharged through a suitable valve, or continuously discharged through a suitable water leg. For purposes of safety a rupture diaphragm 18 is provided in the top of housing 16. Although any type of motive means, such as hydraulic pump or electric motor could be used to power the rams, both cylinders 2 and 2' are preferably powered by a single hydraulic power unit. The two parallel tubes operate in tandem. As the ram in one pelletizing tube moves back, the other moves forward, so that they are always about 180° out of phase. This relationship permits sharing of a common feed hopper, rotating vane and hydraulic power system, which considerably reduces the complexity and cost of the apparatus.

Figure 4:
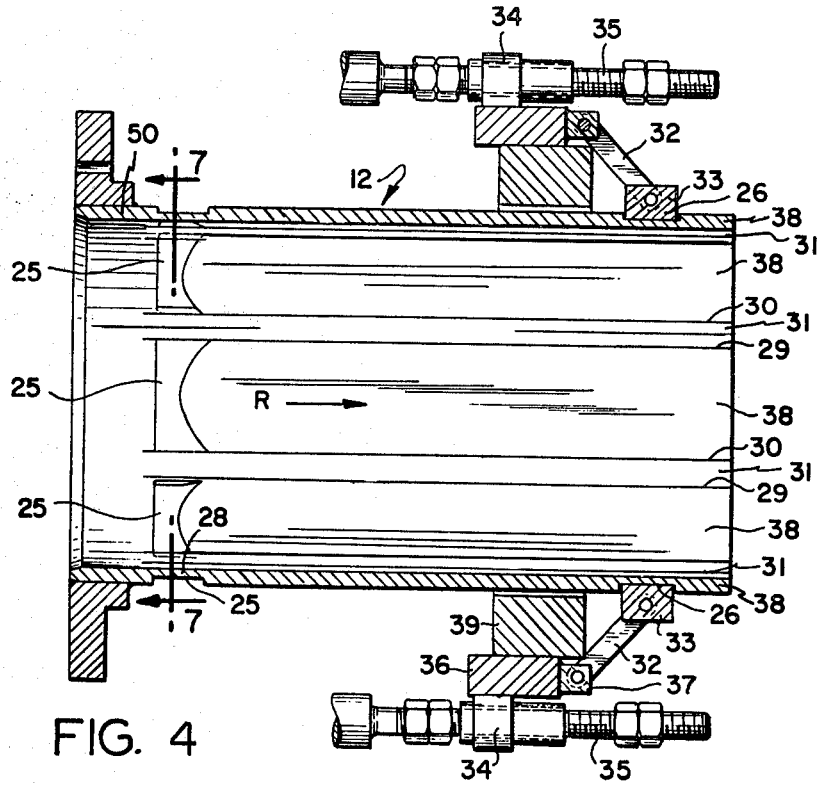
FIG. 4 is an enlarged longitudinal view in partial cross-section illustrating the restrictor assembly shown in FIG. 1.

FIG. 4 shows the preferred structure of the restrictor assembly. The restrictor assembly 12 is made up of a 2 ft. length of the tube 1, which has an inside diameter of 13 inches. The restrictor assembly 12 consists of eight movable restrictor leaves 38 which function together to comprise the restrictor means. Each leaf 38 has been cut from a section 50 of tube 1 so that it forms a smooth continuation of the inside tube wall. Hinges for the leaves 38 may be made by milling eight grooves 25 around the outside surface of tube section 50. A like number of grooves (not shown) are machined around the inside surface of the steel tube opposite slots 25 so that the grooves are parallel to each other, leaving only a thin flexible section 28 of the original tube thickness. A plurality of parallel cuts 29 and 30 are made axially through tube section 50 down to the end of the flexible section 28, thereby producing the leaves 38. Since the thin sections 28 are flexible, the leaves are free to be moved radially inward or outward by exerting a force on their downstream ends. It is important that each pair of cuts 29 and 30, and consequently each pair of edges of leaves 38, be parallel to each other. This is necessary because as the downstream end of a leaf 38 moves in or out, the clearance between each leaf and the stationary portions 31 left between each of the leaves does not change. This constant clearance avoids packing of refuse and consequent jamming which would result if radial cuts were made. Cutting leaves 38 from the tube section 50, will leave eight truncated cone shaped sections 31 between the leaves. These sections 31 remain an integral part of the tube section 50.

The manner in which leaves 38 are moved in or out can best be seen by reference to FIG. 4. A set of eight blocks 33 are each fixedly attached to the downstream end of each leaf. A pair of links 32 (only one is seen) are pivotally attached to each side of each block 33 at one end and to a ring 36, through blocks 37 fixedly attached to ring 36, at their other end. Ring 36 is in sliding contact with ring 39 which is fixedly attached to the stationary sections 31 between the leaves. A spacer (not shown) may be used in between ring 39 and the fixed member 31 in order to make it possible for the leaves to be movable in the radially outward direction. Ring 36 is also fixedly attached at three equally spaced locations around its outer circumference to three nuts 34 (only two are seen) which are threaded on the inside. Threaded rods 35 engage the inside threads of each nut 34. Rods 35 while rotatable in place by a drive means (not shown), are attached so as to be unable to move from left to right. Consequently, rotation of rods 35 will cause ring 36 to be moved from left to right in FIG. 4. The three rods 35 are geared together and commonly driven in order to insure that ring 36 always remain in a plane perpendicular to the axis of the tube 50. As ring 36 is caused to move toward the right, it will exert a force through links 32 upon each of the blocks 33 and hence upon each leaf 38, causing the leaves to be moved radially inward. By reversing the direction of rotation of rods 35, ring 36 will be pulled toward the left and leaves 38 will consequently be pulled radially outward. Ring 36 is keyed (not shown) to stationary ring 39 in order to prevent it from rotating relative to tube section 50, thereby insuring that blocks 33 and 37 and hence links 32 remain in proper alignment.

Figure 3:
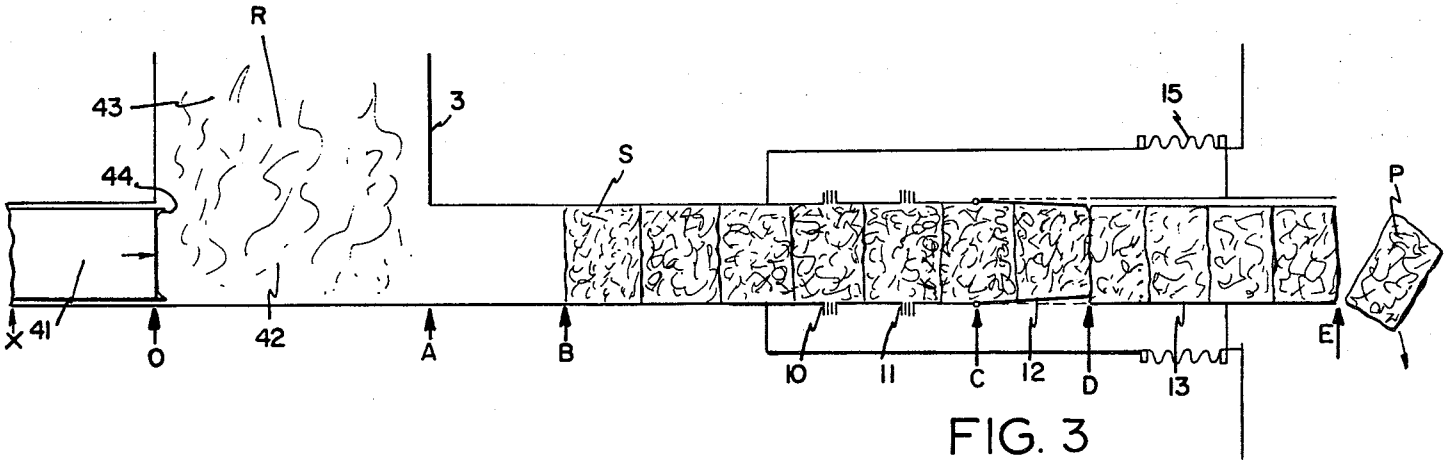
FIG. 3 is a schematic side view illustrating the manner in which the apparatus shown in FIG. 1 functions to provide a dense pellet of refuse.

FIG. 3 shows schematically how the apparatus of FIG. 1 functions to produce the pellets P of shredded refuse. When some loose shredded refuse R is in front of the ram 41 and above the portion swept by the forward stroke of the ram, a vane pushes the refuse down into space 42 swept by the ram. The vane holds the refuse within space 42 during the interval of time the ram travels from point O to point A of the tube. As the ram continues moving to the right, all of the refuse in the volume between points A and B becomes confined, and the further the ram travels to the right the more the refuse in the tube becomes compressed. When the newly compacted refuse is pressed hard enough against an existing slug S of compacted refuse to the right of it, the entire column of compacted refuse in the tube will move to the right. The force required to move this material is determined by wall friction and by the action of the restrictors 12 in the tube section C-D. The sum of the friction produced by the wall and the restrictors determine the compaction pressure the ram will exert on the refuse newly added into the tube.

The column of refuse that moves to the right consists of the above mentioned confined material in the tube between points B and D, as well as the material fitting lossely in the discharge conduit 13 between points D and E. The dense pellet P which is discharged from the end of the conduit at point E will fall into the furnace. Although the compaction process produces considerable cohesion within the mass of refuse that constitutes one single stroke of the ram, i.e. one slug, there is very little bonding between successive slugs or the resultant pellets. Thus, as the material is discharged from conduit 13 at point E, it readily breaks off at the interface boundaries between each pellet. Hence, once steady state operation is reached, each stroke of the ram will, on the average, cause one pellet of compacted refuse to be discharged from the tube. It is to be understood that the term "slug" as used herein is intended to mean the mass of refuse squeezed together by one stroke of the ram. As the slugs are dewatered and moved down the tube over a finite period of time under sustained pressure, they become more coherent, emerging at the end of the tube as strong "pellets".

As noted before, compaction of each new slug of refuse is achieved by squeezing it between the ram and the previously compacted slug downstream. The compaction pressure is the pressure required to move the column of compacted refuse (slugs and pellets) down the tube. In order to control this pressure it becomes necessary to maintain the amount of resistance of motion within a desired range. It has also been found that for a given length of compacted refuse, increasing the compaction pressure increases the force required to push the column down the tube. These two factors lead to the existence of what may be designated as a "critical length" of compacted refuse. That is, the length of compacted refuse slugs in the compacted chamber (section B-D) of the tube, for which the pressure required to move the compacted refuse is just equal to the pressure used to form the slug. This "critical length", however, is not constant, since it is a function of the refuse characteristics. For example, the "critical length" is generally shorter for dry refuse than for wet refuse. It also decreases as the diameter of the tube is decreased.

The effect of the phenomenon referred to above may be illustrated by considering a pelletizer operating at the desired compaction or ram pressure with a column of compacted refuse which is at its "critical length". As long as conditions remain constant, the refuse will continue to be compressed to the desired pressure; that is, the pressure required to just move the column of compacted refuse down the tube. However, this condition is unstable since it will be upset by very slight variations in operating conditions. For example, if the refuse becomes drier, increasing the wall friction, it will increase the compaction pressure on the next slug formed. This will, in turn, further increase the force required to move the column, because the higher compaction pressure causes higher wall friction, and hence will still further increase the compaction pressure on the following slug formed. This chain reaction of increasing compaction pressure will continue until the compaction capacity of the apparatus is reached, when it will become jammed. The increased wall friction described above has caused a decrease in the "critical length" of the compacted refuse. Since the actual length of compacted refuse became greater than its "critical length", the apparatus jammed. The reverse situation will occur if the refuse being fed becomes slightly wetter. In this case the compaction pressure will drop progressively until coherent pellets cease to be formed.

The prior art has attempted to solve these problems by providing additional resistance to motion, over and above that provided by wall friction by placing fixed restrictors in the tube at or near its discharge end. Such restrictors have consisted of one or more objects protruding into the tube, or have consisted of a reduction in tube diameter at the discharge end. However, from a control point of view, such restrictors are simply equivalent to additional tube length, and consequently do not solve the problem, since the same unstable compacting condition as described above still exists.

In order to provide apparatus that will operate stably on refuse, a material which varies almost constantly in composition or moisture content, it is necessary, if operating with a constant ram stroke, (1) to make the length of the compacted chamber of the tube shorter than the shortest "critical length" for the material to be pelletized, and (2) to provide variable resistance to the flow through the tube with adjustable restrictors which are responsive to changing conditions, so as to remain within the desired range of compaction pressure. The compacted chamber of the tube length will be B-D (in FIG. 3) if the restrictors are open so that the cross-section within the restrictor section C-D is equal to or less than the cross-section of the tube, and will be B-C if the restrictors are open sufficiently wider than the tube diameter so as to offer very little resistance to pellet motion. The "critical length" must be determined experimentally for the specific material being compacted.

The term "tube" is used throughout the present specification and claims in generic sense to include the entire cylindrical barrel, i.e., the length X-E in FIG. 3. However, it should be noted that the tube has six distinct functional sections. These are best seen in FIG. 3. Section X-O is the ram housing, section O-A is the feed section, section A-B is the compacting section (or compaction zone), B-C is the compacted section, C-D is the restrictor section, and D-E is the (wider) conduit section. Sections B-C plus C-D, i.e. B-D constitutes the compacted chamber of the tube. It is this chamber or section (B-D) which has the "critical length" discussed above. The practical effect of the "critical length" is that if the compacted chamber is made longer than the shortest "critical length" for the refuse being compacted, it will become jammed. In such case, the refuse will not come out the discharge end of the tube regardless of the pressure applied, since increasing the pressure will only jam the refuse into the tube harder.

In order to provide coherent pellets, the pelletizer requires restrictors which act without breaking up the pellets. This can be accomplished by constructing the restrictors as shown, for example, in FIG. 3, so that they form a smooth continuation of the inner surface of the tube; for example, from a cylinder to a smooth gradually tapered truncated cone. In addition, the degree of restriction produced by the restrictors must be variable and rapidly responsive to changes in compaction pressure so as to keep the compaction pressure within the desired preset range. To achieve these results, the restrictors must be controlled so that if the ram pressure required to push the column of compressed refuse through the tube is greater than a predetermined pressure, the restrictors are caused to open slightly; while if the ram pressure is less than a lower predetermined pressure, the restrictors are caused to close down slightly. If the ram pressure is within the preset range, no change is made in the position of the restrictors. The restrictors are also made such that in their fully open position they form an outward flared cone. In this position the restrictors cause less frictional resistance to the flow of refuse than does a straight tube of equal length.

The preferred.system for controlling the restrictors in accordance with the present invention may be illustrated by reference to FIG. 5. The restrictors may be adjusted after each compaction stroke in accordance with the compaction pressure measured during that stroke. If the compaction pressure is less than some predetermined value $P_1$ then the restrictors will be adjusted in (or closed) a predetermined increment. If the pressure is above some predetermined higher pressure $P_2$, then the restrictors will be adjusted out a predetermined increment. If the pressure is between $P_1$ and $P_2$, no adjustment will be made. If the compacting rams are driven by hydraulic cylinders, the hydraulic pressure delivered to the cylinder (i.e. the ram pressure) can be translated into compaction pressure by multiplying the hydraulic pressure by the ratio of the area of the hydraulic cylinder piston to the area of the ram face. The hydraulic and mechanical frictional forces and the force required to push back the retracting ram must be accounted for to get an accurate figure. However, for practical purposes these will be reasonably constant so that hydraulic pressure monitoring alone will serve the purpose.

Curve I in FIG. 5 shows the hydraulic or ram pressure as a function of ram position when a full load of shredded refuse is being compacted. The pressure up to point Z is that just required to overcome fluid plus mechanical friction and to push the other ram back. The pressure starts to rise at point Z as refuse is encountered by the ram and beginning to be compacted. At point M the force against the compacted material in the tube is enough to move the column of refuse in the tube; and from point M to point B, the forward end of ram travel, the pressure is fairly constant. At the end of the travel, point B, the hydraulic pressure drops rapidly in preparation for reversal. The dotted portion of the curve from M to N represents a pressure spike that sometimes occurs just before the column of refuse in the tube starts to move. This occurs, for example, when the refuse contains a large amount of dry papers, and it represents a condition where the static friction of the refuse is greater than the dynamic friction.

For the purpose of determining restrictor adjustment, it would be satisfactory to monitor the pressure at any ram position from points N to B, or from points M to B if there were no pressure spike. However, if there is only a small amount of refuse being compacted, the pressure curve will look like Curve II in FIG. 5. In this case it is not satisfactory to check for a low pressure, i.e. below $P_1$ until after point M'has been reached. Hence, it has been found desirable to measure the pressure for the purpose of determining if it is below $P_1$ as late in the stroke as possible. Preferably, this pressure monitoring starts at point Y, which may be about one inch from the forward end of the ram stroke, and stops at point B when the forward end of the ram travel is reached, but before the hydraulic pressure drops down in preparation for reversal.

There may be occasions when there is no refuse at all in the compaction zone. In such case the pressure curve will look like Curve III in FIG. 5. The reason the pressure rises near the end of the stroke in this case is that the refuse compacted on the previous stroke springs back a little when the ram is retracted, and this refuse is recompressed on each successive ram stroke. It can be seen that the pressure at point Y where pressure monitoring for $P_1$ starts is far below what it would have been (as shown by Curves I and II) had refuse been fed into the tubes. This would cause a signal to adjust the restrictors "in", when in fact, no adjustment should be made. To take this situation into account, as well as very small loads that might give pressure curves between curves II and III, the pressure should be monitored at a second point X which may be about 6 inches from the forward end of the ram stroke. The control system is then designed so that if the pressure at point X is not above some predetermined pressure $P_3$, which is lower than $P_1$, no subsequent "in" adjustment will be made during that cycle, no matter what the pressure is after the ram is past point X.

The location of point X (the lock-out point) and the value of $P_3$ (the lock-out pressure) must be determined for each application according to its requirements. The point represented by the intersection of a vertical line through X and a horizontal line through $P_3$ on FIG. 5 must lie in the shaded area between curves II*a* and III*a* and as close as possible to curve II*a*. Curve II*a* represents the smallest increment of feed and the lowest compaction pressure for which an "in" adjustment will be made. Completely automatic operation is obtained over the widest range of conditions if the dotted extension of curve II*a* (where the pressure trace would have gone if there had been enough restriction) would reach a pressure of $P_1$ a little before the ram reaches position Y and if $P_4$ is the lowest compaction pressure consistent with having a practicable operating zone between the curves II*a* and III*a*. The curve III*a* represents the pressure trace of the no-feed stroke following a maximum spring-back condition. With municipal refuse this maximum spring-back condition probably occurs when the refuse is all dry paper or cardboard and the compacter is operating at its maximum compaction pressure.

It is also necessary to monitor excessive pressure, i.e. pressure greater than $P_2$ to initiate an "out" adjustment of the restrictors. This, however, is not as critical as the above, and can be done at any point after the ram has passed point A in FIG. 3, which corresponds approximately to point Z in FIG. 5. The pressure $P_2$ may be monitored for a possible "out" adjustment during the interval that the ram travels from X to B in FIG. 5 or it may be monitored from Y to B as in the case of $P_1$. This later monitoring avoids most undesirable adjustments that might be caused by the pressure spikes as shown by the dotted lines between M and N. Normal pressure settings for $P_1$, $P_2$ and $P_3$ for making good pellets from municipal refuse are about 500 psi, 800 psi and 200 psi, respectively.

An electrical circuit which may be used to accomplish the above described control function is shown schematically in FIG. 6. For purposes of simplicity the following symbols are used to describe the circuit shown in FIG. 6.

1LS — Limit switch closed from ram position A to full retract - (O).

2LS — Limit switch opens at full forward only.

3LS — Limit switch closed from ram position X to full forward (B).

4LS — Limit switch closed from ram position Y to full forward (B).

1PS — Pressure switch set to open at $P_1$.

2PS — Pressure switch set to close at $P_2$.

3PS — Pressure switch set to open at $P_3$.

CR — Control Relay

TR — Time Delay Relay

MF & MR — Coils of magnetic starter that operates forward (MF) and reverse (MR) drive of motor that adjusts restrictor.

Operation of the circuit is as follows. The numbers in parenthesis following the symbols refer to the line numbers in FIG. 6.

A ram, prior to reaching position A as it moves forward permits relay 1CR (1) to be energized by 1LS (1) and sealed in by 2LS and 1CR-2(2). Contact 1CR-1 (3) closes and sets up for pressure monitoring as the ram proceeds. Switch 3LS (3) closes at ram position X which is about 6 inches before the end of the ram travel. If the pressure at this point (or any time up to the end of ram travel) is over $P_2$, timer 2TR will be energized through the closed contact of 2PS (6). Contact 2TR-2 (8) closes instantly to operate magnetic starter coil MR (8) which runs the drive motor (not shown) to open the restrictors. When the ram opens the forward limit 2LS (2) the circuit is opened by 1CR (1). Relay 1CR will remain de-energized since 1LS (1) is open during the ram position from ram position A to full forward. Contact 1CR-1 (3) now opens and drops out 2TR. After a delay 2TR-2 (8) opens and stops the restrictor drive. Going back to the point above where 3Ls (3) had just closed at ram position X, if the pressure is over $P_3$ pressure switch 3PS (4) will be open and 2CR will not be energized. Switch 4LS (3) closes at ram position Y completing the circuit to 1PS through the still closed contacts of 2CR-1 (3). If the pressure is now below $P_1$ 1PS (3) will be closed and 1TR will be energized. This closes the restrictor by the same sequence of events detailed above for opening it. If the pressure remains above $P_1$ during the interval between closing of 4LS (3) and the end of ram travel (which opens 1CR-1 (3), no restrictor "close" adjustment is made. Going back again to the point above where 3LS (3) had just closed at ram position X, if the pressure is less than $P_3$ the pressure switch 3PS (4) will be closed and 2CR (4) will be energized and sealed in by 2CR-2 (5). Contact 2CR (3) will open and remain open during the remainder of ram forward travel. This will prevent any energizing of 1TR regardless of the pressures that occur. This is to prevent restrictor closing when there is no feed.

Note that the pressure monitoring circuits (3 to 6) are effective in the forward motion of the ram only as it passes through the gate from ram position X to end of travel, hence false pressure signals at other times will have no effect. Note also that instant (not timed) contacts of 2TR-1 (3) and 1TR-1 (6) prevent simultantous energizing of both time relays. If there is a pressure cycle that would operate both relays, only the one in the circuit energized first would actually operate.

What is claimed is:

1. A process for automatically controlling the amount of restriction in apparatus for compacting refuse comprising (a) a cylindrical tube having an inlet end, a discharge end and a compaction zone therebetween, a lock-out point located near the forward end of the compaction zone, and a last smallest practicable interval of forward ram travel located downstream of the lock-out point, (b) an axially-aligned, reciprocating, driven ram in the inlet end of said tube, said ram being capable of traveling through the compaction zone, (c) a discharge port in the open discharge end of said tube, and (d) a plurality of restrictors near the discharge end of the tube for controlling the compaction pressure exerted by the refuse, said restrictors being capable of being moved inward and outward during each ram stroke in response to changes in the ram pressure required to advance the refuse through said tube, said process comprising the steps of:

(1) measuring the ram pressure during the last smallest practicable interval of forward ram travel, (2) adjusting the restrictors inward a predetermined distance if the ram pressure measured in step (1) is less than a predetermined pressure $P_1$, (3) measuring the ram pressure when the ram is at the lock-out point in its forward stroke, (4) overriding step (2) by making no inward restrictor adjustment if the pressure measured in step (3) is less than a predetermined lock-out pressure $P_3$, where $P_3$ is the lock-out pressure and is less than $P_1$, (5) measuring the ram pressures during at least the last smallest practicable interval of forward ram travel, and (6) adjusting the restrictors outward a predetermined distance if the ram pressure measured in step (5) is greater than a predetermined pressure $P_2$, where $P_2$ is greater than $P_1$.

2. A process as in claim 1, wherein the interval of ram travel for the pressure measurement taken in step (1) is approximately the last 1 inch of forward ram travel.

3. A process as in claim 1, wherein the ram pressure measurement taken in step (3) is made at a point approximately 6 inches from the forward end of its stroke.

4. A process as in claim 1, wherein the ram pressure measurement taken in step (5) is made starting from the time when the ram enters the compaction zone and continuing to the forward end of the ram stroke.

5. A process as in claim 1 wherein the interval of ram travel for the pressure measurement taken in step (1) is approximately the last 1 inch of forward ram travel, wherein the ram pressure measurement taken in step (3) is made at a point approximately 6 inches from the forward end of its stroke, and wherein the ram pressure measurement taken in step (5) is made starting from the time when the ram enters the compaction zone and continuing to the forward end of the ram stroke.

6. A process as in claim 1 wherein $P_1$ is about 500 psig, $P_2$ is about 800 psig and $P_3$ is about 200 psig.

7. A process as in claim 5, wherein $P_1$ is about 500 psig, $P_2$ is about 800 psig, and $P_3$ is about 200 psig.

* * * * *